United States Patent [19]

Daglis

[11] 4,041,827

[45] Aug. 16, 1977

[54] TONE ENHANCING DEVICE FOR REED TYPE MUSICAL INSTRUMENTS

[76] Inventor: Nicholas T. Daglis, 42-23 Clearview Exp., Bayside, N.Y. 11361

[21] Appl. No.: 700,796

[22] Filed: June 29, 1976

[51] Int. Cl.[2] ..... G10D 9/02

[52] U.S. Cl. ..... 84/383 R

[58] Field of Search ..... 84/383, 383 A

[56] References Cited

U.S. PATENT DOCUMENTS

| | | | |
|---|---|---|---|
| 2,397,593 | 4/1946 | Brilhart | 84/383 |
| 2,494,231 | 1/1950 | Dunn | 84/383 |
| 2,525,523 | 10/1950 | Chance | 84/383 |
| 3,202,032 | 8/1965 | Strathmann | 84/383 |

FOREIGN PATENT DOCUMENTS

| | | | |
|---|---|---|---|
| 646,895 | 11/1950 | United Kingdom | 84/383 |

*Primary Examiner*—Stephen J. Tomsky

*Attorney, Agent, or Firm*—John K. Conant

[57] ABSTRACT

A tone enhancing element incorporated within the mouthpiece of a reed type musical instrument, such as a saxophone or clarinet, has two steps projecting into the air flow-through passage of the mouthpiece at a point opposite the opening over which the reed is mounted. The first step in from the outward end of the mouthpiece is the lower of the two, projecting into the passage less than the second step. The element may be a removable element that can be taken out for cleaning, for example, or it may be an integral portion of the mouthpiece structure.

5 Claims, 5 Drawing Figures

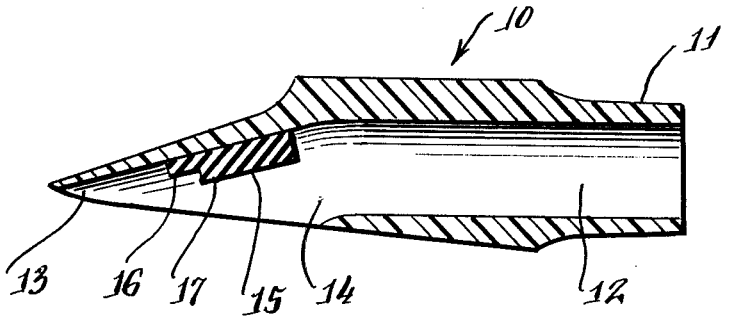
Fig. 2.
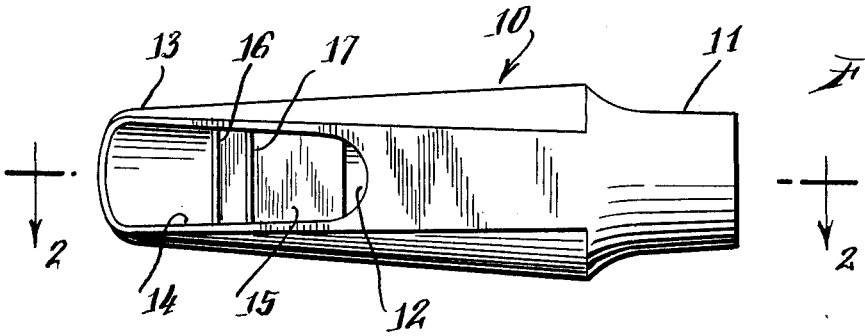
Fig. 1.
Fig. 3.
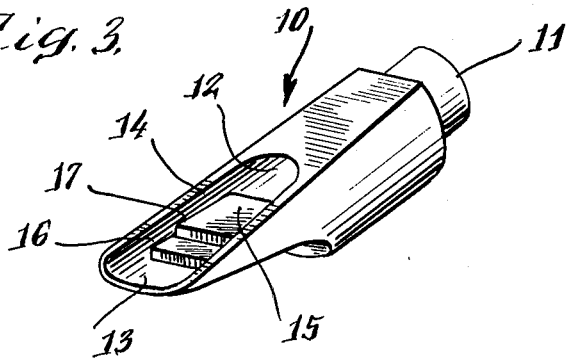
Fig. 4.
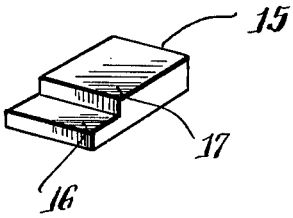
Fig. 5.
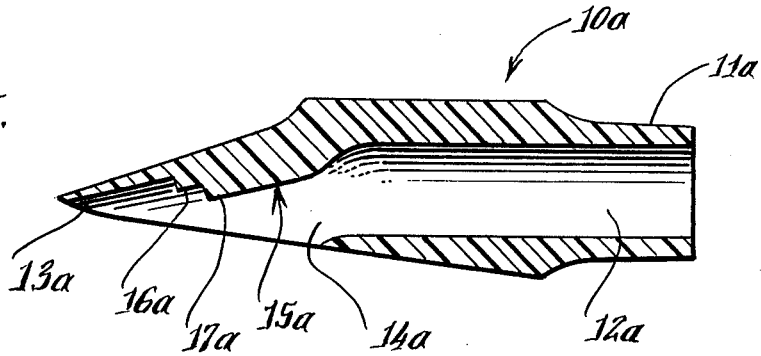

TONE ENHANCING DEVICE FOR REED TYPE MUSICAL INSTRUMENTS

BACKGROUND OF THE INVENTION

The tone enhancing device of this invention is for reed type musical instruments such as saxophones and clarinets. It is an element within the mouthpiece of the instrument and operates to enhance the brilliance, richness and fullness of the tone produced by the player without altering the tonal qualities that are characteristic of the particular instrument and of the particular player. A player is thus enabled to produce a fuller, more brilliant tone with less effort, and without losing or obscuring his personal "sound".

The element consists essentially of two clearly defined steps projecting into the air flow-through passage of the mouthpiece.

It has been known to insert, or provide, various types of partial obstructions in the mouthpiece of a reed type musical instrument for modifying the tone or the sound. For example, U.S. Pat. No. 2,397,593 to A. Brilhart discloses a ramp shaped member adapted to be inserted in a mouthpiece for producing a different tone, the particular character of the tone being determined by the material — plastic, metal or various woods, for example — of which the member is made. As noted above, however, a principal purpose of the present invention is to enhance, not modify, tonal characteristics, and this is accomplished by the structural configuration of the element of this invention and not the material of which it is made. The material is not critical amd the tonal effects due to the material used is negligible in comparison to the tone enhancement due to the structural configuration of the element.

SUMMARY OF THE INVENTION

The element of this invention, which may be a removable insert or an integral part of the mouthpiece structure, consists of two clearly defined steps projecting into the mouthpiece air flow passage from the wall opposite the opening over which the reed is mounted. The first step in from the outward end of the mouthpiece is the lower of the two; that is, the second step projects further into the air flow passage than the first step.

It is believed that the tone enhancing effect of the two stepped element of this invention is due to the interruption it causes in the air flow and particularly to the unique turbulence it produces which vibrates the reed faster, and in a manner that results in a bigger and brighter sound, and one that is more responsive to the tonal qualitities imparted by the player, without altering the basic tonal characteristics of either the player or the instrument.

DESCRIPTION OF THE DRAWINGS

The invention is described in more detail below with reference to illustrative embodiments shown in the accompanying drawings in which:

FIG. 1 is a bottom view of a mouthpiece incorporating a two stepped, tone enhancing element of this invention, showing the mouthpiece with the reed removed so that the element is visible through the opening over which the reed is normally mounted;

FIG. 2 is a sectional view on the line 2 — 2 of FIG. 1;

FIG. 3 is a perspective view of the mouthpiece shown in FIG. 1;

FIG. 4 is a perspective view of an element of this invention which is in the form of a removable insert adapted to be positioned in the air flow passage of a conventional mouthpiece; and FIG. 5 is a longitudinal sectional view through a specially constructed mouthpiece embodying the invention wherein, as an alternative form, the element is an integral part of the mouthpiece structure.

DETAILED DESCRIPTION

Referring to the embodiments illustrated in FIGS. 1 to 3 and 5, a conventional style of mouthpiece 10 or **10*a* for a reed type musical instrument, such as a saxophone, has one end 11 adapted to fit into a bore in the instrument (not shown) and an air flow passage 12 through the mouthpiece from end to end. The other, outward, end 13 of the mouthpiece is generally wedge or V-shaped with the outward end of the passage 12 opening through one side of the V, as indicated by the opening 14. The side having the opening 14 therethrough is configured for a reed (not shown) to be mounted over the opening by well known means (not shown) such as a ligature over the base of the reed and around the body of the mouthpiece. Musical sounds are produced by a player placing his lips over the V-shaped end of the mouthpiece and blowing air into the instrument, between the reed and the edges of the opening 14;** this causes the reed to vibrate which in turn vibrates the column of air defined by the interior length of the instrument and mouthpiece.

In the embodiment illustrated in FIGS. 1 to 4, the tone enhancing element 15 of this invention is a removable insert adapted to be fixed within the passage 12 against the wall of the passage at a position opposite the opening 14.

The element 15 has two well defined steps 16 and 17 which, as shown, are suitably about the same height, though sameness of height of the steps is not critical. The element 15 is arranged in the passage 12 so that the lower step 16 is toward the outward end 13 of the mouthpiece. In other words, the second, higher, step 17, which projects further into the passage 12, is innermost from the outward end 13.

The removable element 15 may be made of any suitable material and may be fixed in position within the passage 12 in any effective manner, such as by an adhesive or by frictional engagement. In a preferred form, the element 15 is made of a resilient rubber or rubber-like material, such as a natural or synthetic rubber or a plastic, which is preferably selected to be washable and so as not to chip or break easily. The resilient form of the element 15 is adapted to be held in fixed position within the passage 12 by frictional engagement of its sides against the side walls of the passage. In this way the element is readily removable for cleaning.

The configurations and dimensions of the interior passage of some different makes and styles of mouthpieces are different and the elements 15, which are removable inserts, may be made in various widths, respectively to fit various mouthpiece configurations.

FIG. 5 illustrates an alternative embodiment in which the tone enhancing element, designated **15*a* in this instance, is integral with the structure of the interior wall of the air flow passage 12*a*, and consists of two steps, 16*a* and 17*a*, comparable in configuration and arrangement to the steps 16 and 17 of the element 15 of the embodiment shown in, and described with reference to, FIGS. 1 to 4**.

What is claimed is:

1. A tone enhancing element for incorporation in the mouthpiece of a reed type musical instrument, said mouthpiece having an air flow-through passage opening through the end of the mouthpiece to which a player applies his mouth to play the instrument, said end being generally V-shaped with said opening and its adjacent edge portions being shaped for a reed to be mounted over the opening, said element comprising:

two successive, substantially well defined steps adapted to be positioned to project into said passage from the interior wall thereof opposite said opening, with the first of said steps in from said end of the mouthpiece being lower than the second so that the second step projects further into said passage than the first.

2. The tone enhancing element of claim 1 in which said steps are substantially the same height.

3. The tone enhancing element of claim 1 which is adapted to be retained in said position in said mouthpiece passage by frictional engagement with walls of said passage, whereby said element is removable from said position.

4. The tone enhancing element of claim 3 which is formed of a resilient material that is washable.

5. The tone enhancing element of claim 1 in combination with said mouthpiece wherein said element is an integral part of the structure of said mouthpiece in said position.

* * * * *